US006009705A

United States Patent [19]

Arnott et al.

[11] Patent Number: 6,009,705

[45] Date of Patent: Jan. 4, 2000

[54] NOISE ATTENUATOR FOR AN INDUCTION SYSTEM OR AN EXHAUST SYSTEM

[75] Inventors: Steven Peter Arnott, Salisbury; William Hallam, Southampton; Anthony William Shepperson, Salisbury; Steven Lyddon, Micheldever, all of United Kingdom

[73] Assignee: Tennex Europe Limited, Wiltshire, United Kingdom

[21] Appl. No.: 09/068,142

[22] PCT Filed: Nov. 6, 1996

[86] PCT No.: PCT/GB96/02717

§ 371 Date: May 1, 1998

§ 102(e) Date: May 1, 1998

[87] PCT Pub. No.: WO97/17531

PCT Pub. Date: May 15, 1997

[30] Foreign Application Priority Data

Nov. 6, 1995 [GB] United Kingdom ..... 9522724

[51] Int. Cl.[7] ..... F02B 27/02

[52] U.S. Cl. ..... 60/312; 60/274; 60/322; 181/229; 123/184.57

[58] Field of Search ..... 60/274, 312, 322; 181/229, 224, 230; 123/184.57

[56] References Cited

U.S. PATENT DOCUMENTS

| | | | |
|---|---|---|---|
| 1,910,672 | 5/1933 | Bourne . | |
| 4,381,832 | 5/1983 | Rauch | 181/266 |
| 5,014,816 | 5/1991 | Dear et al. . | |
| 5,040,495 | 8/1991 | Harada et al. | 123/52 |
| 5,377,629 | 10/1993 | Brackett | 123/184.56 |
| 5,424,494 | 6/1995 | Houle et al. . | |
| 5,572,966 | 11/1996 | Doddy et al. | 123/184.57 |

FOREIGN PATENT DOCUMENTS

| | | |
|---|---|---|
| 1123855 | 10/1956 | France . |
| 648727 | 12/1964 | France . |
| 3516442 | 11/1986 | Germany . |
| 2 024 380 | 1/1980 | United Kingdom . |
| 2 038 410 | 7/1980 | United Kingdom . |

OTHER PUBLICATIONS

"Four–cylinder Air Induction", *Automotive Engineering*, vol. 102, No. 2, Feb. 1994, Warrendale, PA, pp. 105–108.

*Primary Examiner*—Thomas Denion
*Assistant Examiner*—Binh Tran
*Attorney, Agent, or Firm*—Westman, Champlin & Kelly, P.A.

[57] ABSTRACT

The present invention provides, with reference to the figure, a noise attenuator for an induction system or an exhaust system comprising a housing (10) having a gas inlet (13), a gas outlet (11) and a first gas flow passage (12) inside the housing connecting the gas inlet (13) to the gas outlet (11). A quarter wave resonator tube (14; 16; 23; 29) is provided inside the housing (10) which opens on to the first gas flow passage. The noise attenuator is an integer which can be installed as a single integrated unit in the induction system or the exhaust system. A Helmholtz resonator (21; 27) is provided inside the housing (10) which opens on to the first gas flow passage (12).

34 Claims, 2 Drawing Sheets

10
11
12
13
14
15
16
17
18
20
21
22
23
24
25
26
27
28
29
31
32
33

10
10A
10B
13
A
A'

NOISE ATTENUATOR FOR AN INDUCTION SYSTEM OR AN EXHAUST SYSTEM

The present invention relates to a noise attenuator for an air induction system or an exhaust system.

The present invention will be described with reference to its use in an air induction system or an exhaust system of an internal combustion engine in an automobile. However, the noise attenuator of the invention should not be considered limited to such a use and it should be appreciated that the invention could be used to attenuate noise in many gas flow systems, (e.g. air conditioning systems, car heater systems, fan systems or domestic appliances) many air induction systems or in many exhaust systems.

It is at present the generally accepted practice in attenuation of noise in air induction systems of internal combustion engines in automobiles to attach to the air induction conduit at separate points along the conduit Helmholtz resonators and quarter wave tube resonators, each resonator being a separate integer and a number of different integers being connected to the air inlet conduit along the length thereof. A summation of the volumes of the separate resonators typically gives a total volume of 12 liters. The different resonators are typically distributed about the engine bay.

In U.S. Pat. No. 5,014,816 there is described a silencer for an air induction system or an exhaust system of an internal combustion engine which comprises a number of quarter wave resonator tubes provided by multiple channels arranged in a single housing. The system is advantageous over certain prior art systems because it is more compact in nature than the previous prior art systems. However, the arrangement of U.S. Pat. No. 5,014,816 has a disadvantage in that very long quarter wave tubes must be used to attenuate low frequencies. Thus the designer must either design a quite large housing to incorporate a long quarter wave tube or alternatively the designer must accept that the induction system will not attenuate the lower frequencies.

The present invention provides a noise attenuator for an air induction system or an exhaust system comprising a housing having:

a gas inlet, an gas outlet, a first gas flow passage inside the housing connecting the gas inlet to the gas outlet, and a quarter wave resonator tube inside the housing which opens on to the first gas flow passage, characterised in that there is additionally provided inside the housing a Helmholtz resonator which opens on to the first passage, whereby the Helmholtz resonator and the quarter wave resonator are together integrated in a single unit and the single unit is connectable in and deconnectable from the induction system or the exhaust system.

The housing of the noise attenuator has a Helmholtz resonator which can attenuate low frequency noise. The present invention thus has the advantage of providing in one housing all of the elements required for attenuation of noise of the air induction system or the exhaust system in a compact manner. Thus, the housing will not need to have a very long quarter wave tube to attenuate low frequency noise.

A Helmholtz resonator has significant advantages over a quarter wave tube resonator in attenuating low frequency noise. Whilst the volume of a Helmholtz resonator for attenuating for example 100 Hz frequency noise will be 2.4 liters and the volume of a quarter wave tube for attenuating the same frequency noise will be less, the quarter wave tube will need to be at least 1 meter long and thus will be harder to package than the Helmholtz resonator. Furthermore, the Helmholtz resonator will provide a better defined frequency band width of noise cancellation than a quarter wave resonator tube.

The present invention provides a noise attenuator as one completely integrated unit which has a number of advantages. First, there is a lower pressure loss across the integrated attenuator than there would be across a prior art system providing similar attenuation but with separate resonators distributed throughout the air induction system. This leads to an increase in the efficiency of the internal combustion engine downstream. Secondly, the applicant has found that a prior art system with a total of 12 liters of resonator volume made up of separate resonators distributed throughout the air intake system can be replaced with a noise attenuator according to the present invention which has a volume in the range of 6 to 10 liters, and preferably about 7 liters, whilst in fact the attenuation characteristics are improved, with a decrease from 74 dB to 71 dB in driveby noise (a noise measured by a standard test imposed by legislation, comprising measurement of noise at 7.5 meters from a vehicle). To achieve the required 3 dB reduction in driveby noise, a reduction of 8 dB in intake contribution to that noise is required. Since the dB measurement is a measurement on a logarithmic scale, the 3 dB decrease represents roughly a halving of noise. The reduced total volume of the noise attenuation system has further benefits in reduced weight of the system and reduced cost of the system. The attenuator of the present invention can achieve the same (and usually better) noise attenuation than the prior art distributed system with a reduced total volume; this is due to a synergistic effect on noise cancellation of including together in one housing a Helmholtz resonator along with quarter wave tube resonators.

The provision of a complete noise attenuator system as a single integer allows design of the noise attenuator to best suit the packaging constraints of a particular application. For instance, the noise attenuator could be designed with a dual purpose in mind, the unit functioning for instance as both a noise attenuator and a wheel arch liner, both a noise attenuator and a bonnet liner or both a noise attenuator and part of an automobile bumper.

The provision of a complete noise attenuation system in one integer further enables reduction in noise by facilitating connection of the integer to the remainder of a vehicle by isolators, for instance rubber isolators. In the past each of the separate components of the noise attenuator system would be able to rattle and it was very difficult and costly to connect each separate component to the remainder of, for instance, an automobile to prevent noise generation. The plurality of walls in the noise attenuator of the present invention also allows it to be made stiff, which helps keep vibrational noises low.

The positioning of the plurality of distributed resonators of the prior art systems whilst restricted by packaging requirements, was chosen so that the positioning of a quarter wave tube or a Helmholtz resonator in the air induction system optimised cancellation of a particular frequency by the resonator. However, it has been found against accepted practice that the disadvantage of locating all of the resonators together at one point in the air intake system is not significant and is outweighed by the advantages of the present invention.

It has been found that provision of a Helmholtz resonator with an inlet passage of a non-circular (and preferably rectangular) axial cross-section, in particular in conjunction with resonator tubes of non-circular (and preferably rectangular) axial cross-section is particularly advantageous. When circular cross-sections are used the noise attenuation characteristics are good but a standing wave tends to be established in the gas flow tube through the noise attenuator. The applicants have discovered advantageously that the waveform of the standing wave can be varied by using non-circular axial cross-sections.

The present invention in one aspect has two or more gas flow passages through the housing which can be beneficial since different aspect ratios (i.e. the ratios between the cross-sectional areas of the gas flow passages and the cross-sectional areas of the resonators) can be chosen for each gas flow passage, which allows better tuning of the noise attenuator.

Sound deadening material can be incorporated in the housing walls of the resonators to enhance noise cancellation.

Injection moulding of parts of the resonator is preferred if accurate tolerances are required, since injection moulding is a precise moulding method (more precise than blow moulding for instance). Polypropylene could be used in the moulding process.

The number of resonators in a housing would vary upwardly from a minimum of one Helmholtz resonator and one quarter wave tube resonator to any number of either resonator depending on the application and the quality of noise cancellation required. The layout of the resonators would also vary depending on packaging requirements and noise optimisation.

Embodiments of the present invention will now be described with reference to the accompanying drawings, in which.

Figure 1:
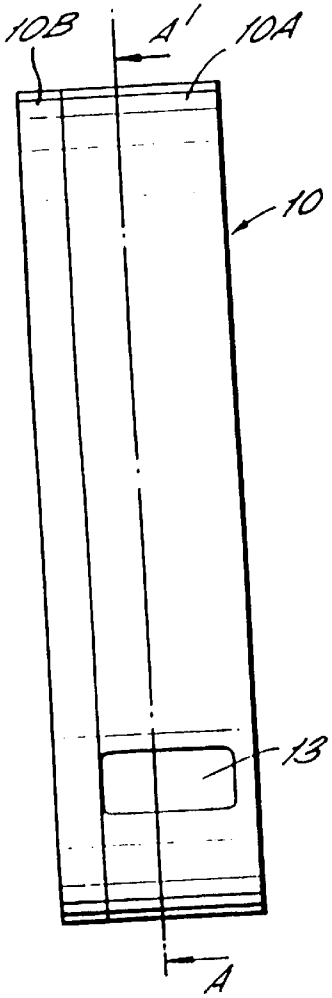
FIG. 1 is a side view of a first embodiment of noise attenuator according to the present invention.

In FIG. 1 it can be seen that the noise attenuator of the invention is a single integer which comprises a housing 10 which is a moulded plastic housing. The housing 10 has a maximum depth of 100 mm. The housing 10 can be seen to have an inlet orifice 13. This orifice 13 could be an inlet for air in an air induction system of an internal combustion engine. Alternatively the orifice could be an inlet for exhaust gases when the noise attenuator is connected in an exhaust system of an automobile, in which case the housing 10 would be made of metal or some other heat resistant material.

Figure 2:
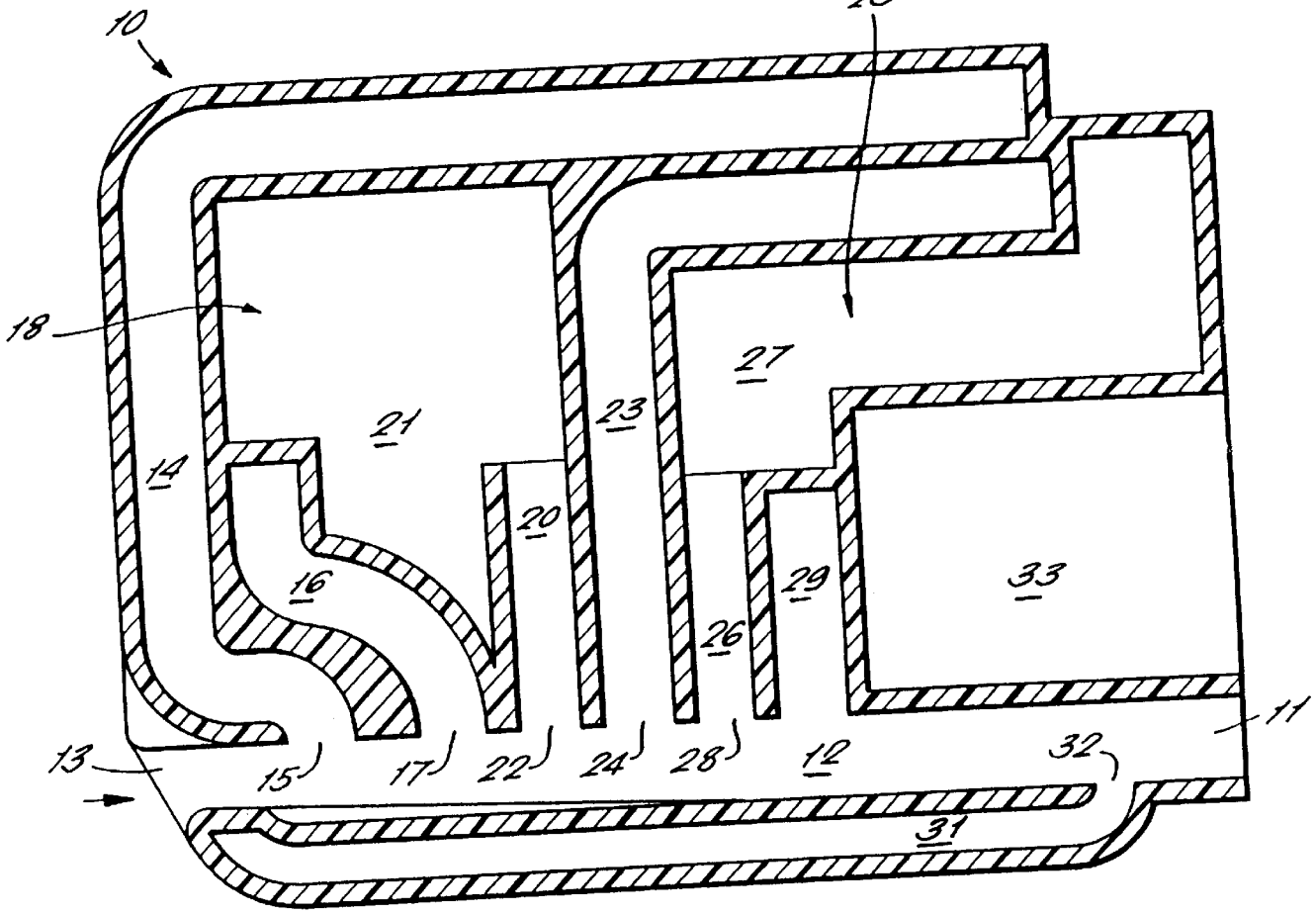
FIG. 2 is a cross-section taken through the noise attenuator of FIG. 1, along the line A–A', in the direction of the arrows.

In FIG. 2 the cross-sectional view of the housing shows that the housing has a first gas flow passage 12 passing through the housing 10 from the inlet orifice 13 to an outlet orifice 11. In use the housing 10 can be connected such that the inlet orifice 13 is connected to an air filter and the outlet orifice 11 is connected to an induction manifold for an internal combustion engine, for instance in an automobile. Alternatively in use the housing 10 can be connected in an exhaust system of an automobile such that the inlet orifice 13 is connected to a pipe leading to the exhaust manifold of the internal combustion engine and the outlet orifice 11 is connected to a pipe which exhausts combusted gases to atmosphere.

The housing 10 will be formed in two parts 10A and 10B (see FIG. 1). The parts are each formed by simple injection moulding operations. Injection moulding has a benefit of producing parts of finer tolerances than are achievable in some other moulding techniques (e.g. blow moulding). The parts 10A and 10B could be moulded from polypropylene or from a nylon-based material, which (whilst more expensive) would lead to a stiffer structure less prone to vibration.

The part 10A is formed with a number of partitions, so that when the two parts 10A and 10B of the housing 10 are joined together the two parts together define tubes and cavities, as will now be described. The greatest dimension of the housing 10 is 540 mm.

In FIG. 2 it can be seen that the housing 10 comprises a first quarter wave resonator tube 14 which is the longest quarter wave resonator tube in the housing 10. The quarter wave resonator tube 14 is open at its end 15 to the first gas flow passage 12. The quarter wave resonator tube 14 is L-shaped and extends along two sides of the housing 10.

A shorter quarter wave resonator tube 16 is also provided in the housing 10 and this tube has an end 17 which is open to the first passage 12. As air or exhaust gas passes through the first passage 12 from the inlet orifice 13 to the outlet orifice 11, the gas sequentially passes first past the opening 15 of the quarter wave tube 14 and then past the end 17 of the quarter wave tube 16.

The gas which has passed the end 17 of the quarter wave resonator tube 16 next passes an end 22 of a Helmholtz resonator 18. The Helmholtz resonator 18 comprises an inlet passage 20 which extends into a cavity 21. Both the inlet passage 20 and the cavity 21 are defined by the shape of the two parts 10A and 10B of the housing 10 when the two parts 10A and 10B are brought together.

After the gas passes the open end 22 of the tube 20, the gas passes an open end 24 of a quarter wave resonator tube 23. The quarter wave tube 23 is L-shaped as viewed in FIG. 2 and extends first at right angles to the first passage 12 and then curves through 90° to lie parallel to the end portion of the quarter wave resonator tube 14.

After the gas passes the open end 24 of the quarter wave resonator tube 23, the gas next passes an open end 28 of a Helmholtz resonator 25. The Helmholtz resonator 25 comprises an inlet passage 26 which opens into a cavity 27, the inlet passage 26 and the cavity 27 both being defined by the shape of the two parts of the housing 10.

The gas passing along the first passage 12 after passing the open end 28 of the Helmholtz resonator 25 next passes the open end of the shortest quarter wave resonator tube 29. The quarter wave resonator tube 29 is defined when the two parts 10A and 10B of the housing 10 are brought together.

The gas passing along the first passage 12 before it reaches the outlet 11 lastly passes an open end 32 of a quarter wave resonator tube 31. Whilst the quarter wave resonator tubes 14, 16, 23 and 29 lie on one side of the gas flow passage 12, the quarter wave resonator tube 31 lies on the opposite side of the gas flow passage 12 but in the same plane.

Also shown in FIG. 2 is a removable panel 33 defined in the housing 10. The housing 10 is designed to be positioned on the top of an internal combustion engine when in use and the removable panel 33 can be removed to allow access to an oil filler cap lying below the housing 10.

It will be appreciated that the noise attenuator of the invention can be made economically, because only two different moulded parts need be made, these then being joined together to form the housing with the quarter wave resonator tubes and the Helmholtz resonators defined in the housing by a series of partitions formed during the moulding process of one part 10A of the housing 10, which co-operate with the other part 10B of the housing 10 to form the resonators. The parts 10A and 10B are not equal in size and it can be seen in FIG. 1 that part 10A occupies four fifths of the total depth of the housing 10 and part 10B the other fifth.

The figures do not fully illustrate the fact that the depth of the Helmholtz resonators is greater than the depth of the quarter wave resonator tubes. The opposed surfaces of the two parts 10A and 10B of the housing 10 will each have a complex three dimensional shape, designed so that the quarter wave resonator tubes and the Helmholtz resonators have the required three dimensional shapes when the two parts 10A and 10B of the housing 10 are brought together and joined to one another. The bottom of each of the Helmholtz resonators 18 and 25 (as seen in FIG. 2) will be flat.

The quarter wave resonator tubes in the preferred embodiment each have a roughly rectangular axial cross-section, the corners of the rectangular axial cross-section being rounded. Also, the inlet passages 20 and 29 of the Helmholtz resonators 21 and 27 have roughly rectangular axial cross-sections, the corners of the axial cross-section being rounded.

It has been found that it is surprisingly important to have non-circular axial cross-sections. Whilst circular axial cross-sections do provide reasonable noise attenuation, a standing wave can form in the gas flow passage 11 which can contribute significantly to noise levels. The waveform of the standing wave in the gas flow passage 11 can be changed by choosing non-circular (and preferably rectangular) axial cross-sections with a resulting decrease in noise. The axial cross-sections could be oval, hexagonal or any other non-circular shape, but it is preferred that the smallest dimension of the cross-section is parallel to the axis of the gas flow passage 11.

The exact dimensions of the quarter wave resonator tubes and the Helmholtz resonators and the layout of the resonators will be chosen for a particular application, having in mind the acoustic frequency spectrum of the gas flow which is to be attenuated.

For a quarter wave tube used for an air induction system the basic equation $f=C/4L$ (a very simplified equation which ignores, for example, temperature and end effects) can be used to calculate chosen lengths (although more complicated mathematical models are preferred), where f is the tuned frequency, C is the approximate speed of sound in air at 20° C. and L is one length of the centre line of the channel. For example with a centre length of 0.6 meters then $f=340/2.4$ and $f=141$ hertz. If the centre length were 0.45 meters then $f=340/1.8$, in other words $f=189$ hertz.

For a Helmholtz resonator the dimensions of the tube and the cavity forming the Helmholtz resonator are tuned to attenuate specific frequencies. This is done for an air induction system using the basic equation $f=C/2\pi\sqrt{(A/LV)}$ (a very simplified equation which ignores, for instance, temperature and end effects), where f is the tuned frequency, C is the speed of sound in air, A is the cross-sectional area of the tube leading to the cavity, L is the length of the tube leading to the cavity and V is the volume of the cavity. In practice a more complicated mathematical model would be preferred.

For example the tube 20 of Helmholtz resonator 18 could be chosen to have a length of 100 mm and a cross-sectional area of 1256 $mm^2$. The cavity 21 could be chosen to have a volume of 1.47 liters. In this case the tuned frequency would be 141 hertz. The tube 26 of the Helmholtz resonator 25 could be chosen to have a length of 45 mm and a cross-sectional area of 1256 $mm^2$. The volume of the cavity 27 of the Helmholtz resonator 25 could be chosen to be 1.40 liters. In this case the tuned frequency would be 191 hertz.

If the two equations for calculation of frequency f are considered carefully it can be seen that whilst a long length is needed for a quarter wave resonator to damp low frequencies, the length of the tube of the equivalent Helmholtz resonator can be made quite short, because the frequency is very dependent on the area and length of the tube and the volume of the Helmholtz resonator. A tube with a small area and a cavity with a large volume can be chosen to attenuate low frequencies, without the problem of having to package a very long quarter wave resonator tube in the housing of the noise attenuator.

The equations given above are only the basic equations for the resonators which are given merely to demonstrate the different characteristics of Helmholtz and quarter wave resonators. The exact tuning frequencies are dependent on many factors such as the dimensions of the openings of the resonators.

In FIG. 2 the quarter wave resonator tubes are each shown with a closed end. In fact, in practice each quarter wave resonator tube may have a small hole in its end, in order to allow drainage of moisture from the quarter wave resonator tube. Although, air induction systems are ideally watertight some moisture does enter and there must be a means for escape. The hole will be chosen to be small enough to have a minimal effect on the acoustic properties of the quarter wave tube. Similarly, the Helmholtz resonators may each have a small hole in order to allow drainage of moisture from within the housing 10. Again, the holes in the Helmholtz resonators will be chosen to be small enough to have a minimal effect on acoustic properties of the Helmholtz resonators.

Whilst above it is mentioned that the housing is made of plastic material by injection moulding, the housing could also be manufactured by stamping two metal sections and the joining the two metal sections together. Indeed the housing could be made by many different manufacturing techniques, e.g. rotary moulding or in many different materials, e.g. fibre glass or any fibrous material. The two parts of the housing could be moulded together or secured together using mechanical fastening or in any other suitable way. Alternatively the housing could be made as a unitary member.

Whilst in the embodiment mentioned above there are five quarter wave resonator tubes and two Helmholtz resonators, this is not critical and the number of quarter wave resonator tubes and Helmholtz resonators can be varied for different applications. What is important in each application is to analyse the frequency spectrum of the acoustic noise to be attenuated and then to choose the best combination of quarter wave resonator tubes and Helmholtz resonators to attenuate the acoustic noise. Generally, the Helmholtz resonators are chosen to attenuate low frequency portions of the frequency spectrum and the quarter wave resonator tubes are designed to attenuate high frequency components of the acoustic frequency noise spectrum, although there will be a cross-over for mid-range frequencies. The quarter wave resonator tubes and the Helmholtz resonators can be made in many different shapes according to packaging requirements and the quarter wave resonator tubes can for instance be straight tubes or can be curved. Indeed, some quarter wave resonator tubes can be turned through any angle (e.g. 90°).

Also the quarter wave resonator tubes could be made with a three-dimensionally varying shape, e.g. one could be formed as a helix. It is preferred that the cross-sectional area of each quarter wave resonator tube is substantially uniform over its entire length.

It will be appreciated that the housing 10 has a thickness dimension (110 mm) which is much smaller than the other dimensions of the housing. This permits the housing to be located for instance, above an engine, between the engine and a bonnet, where space is limited. The housing can in fact be located easily anywhere in the engine bay, for instance attached to a side wall of the engine compartment. Indeed, the noise attenuator can be provided anywhere in a vehicle, not necessarily in the engine bay. Also the housing could serve another purpose in the vehicle (e.g. the housing could be part of a bumper of the vehicle).

Whilst above the housing 10 is formed of two separate parts 10A and 10B, it is envisaged that the housing could equally well be formed of any number of different parts and indeed the housing could be formed as one structure as a single part.

The housing 10 can be fabricated by moulding resin or from a fibrous material. For instance lightweight polymeric materials such as thermoplastic or thermosetting resins can be used. Also composite materials can be used.

The noise attenuator described above has been described for use in attenuating noise in an air induction system or an exhaust system of an internal combustion engine, but the noise attenuator could equally well be used with a compressor, a turbine or a pump. Indeed the noise attenuator could be used in any system (e.g. an air conditioning system) which has a plurality of ducting components and a component which generates noise or in any system where gas has to flow through a variety of chambers of different dimensions.

In the embodiment described above one of the quarter wave resonator tubes lies on a side of the air gas induction passage which is opposite to the other quarter wave tubes. This a preferred feature because it improves packaging characteristics.

In the embodiment of the invention described above the gas flow through the first passage 12 in the housing after passing the open end of one Helmholtz resonator must then pass the open end of a quarter wave tube before passing the open end of the second Helmholtz resonator. When designing the layout of the noise attenuator the designer will have in mind the fact that the main flow path (i.e. the gas flow path 11) will itself resonate at a particular frequency and therefore will include in the attenuator a quarter wave resonator tube or a Helmholtz resonator designed to attenuate noise created by the resonance of the main flow path. The positioning of this quarter wave or Helmholtz resonator will be chosen to maximise the benefit of the noise attenuator. When this position is fixed then the relationship of the other resonators to one another will preferably be chosen such that resonators which open consecutively (in the direction of gas flow) on to the main flow path have resonant frequencies distant from each other in order that maximum benefit is obtained from the noise attenuation provided by each. In other words, it is beneficial to separate resonators which have similar resonant frequencies. However, the resonators do not have to be positioned in this way and could be packaged in any way which gives a good compromise between packaging and acoustic performance.

While the divider walls described above which divide the resonators are solid walls, they could equally well be cavity walls, with two skins separated by an air gap.

Separate spaced divider walls could be provided for each resonator, the externally facing surfaces of the divider walls being separated from each other for instance by an air gap. This could be done to strengthen the housing since the divider walls could form reinforcing corrugations for the housing.

Whilst the housing described above is shaped like a rectangular box and this is advantageous for manufacturing practicalities and for packaging considerates, the housing could have any form, e.g. it could be cylindrical or spherical in nature (although both of these forms take up more space in situ than a rectangular box of a similar volume).

When the attenuator is used in an air induction system it can be located on the "dirty" or the "clean" side of the air filter (i.e. either before or after the air filter in the direction of gas flow). It may be preferred to enhance the noise attenuating performance of the noise attenuator by coating the inwardly facing surfaces of the resonators with a secondary noise deadening (e.g. fibrous) material. In this case the noise attenuator would be located on the "dirty" side of the air filter so particles coming loose from the sound deadening material will not enter the engine.

While in the embodiment described above the inwardly facing surfaces of the gas flow path is a smooth plastic surface, this surface could be deliberately given a roughness to improve attenuation characteristics and could be provided with a series of inclined reflecting surfaces as in an anechoic chamber.

A second embodiment of the present invention will be now described with reference to FIG. 3 in which there is shown a resonator comprising a housing 40. The housing has an inlet 41 which in use is connected to an air filter of an internal combustion engine. The air flows through a gas flow passage 42 in the housing 40 from the air inlet 41 to an air outlet 42, which in use will be connected to the inlet manifold of an engine. As the air flows from the air inlet 41 to the air outlet 43 via the air flow passage 42 it will flow sequentially past:

- an L-shaped quarter wave resonator tube 43,
- a Helmholtz resonator 44 which has an L-shaped inlet passage 45 opening onto the gas flow passage 42;
- a quarter wave resonator 46;
- a quarter wave resonator 47; and
- a quarter wave resonator 48.

Figure 3:
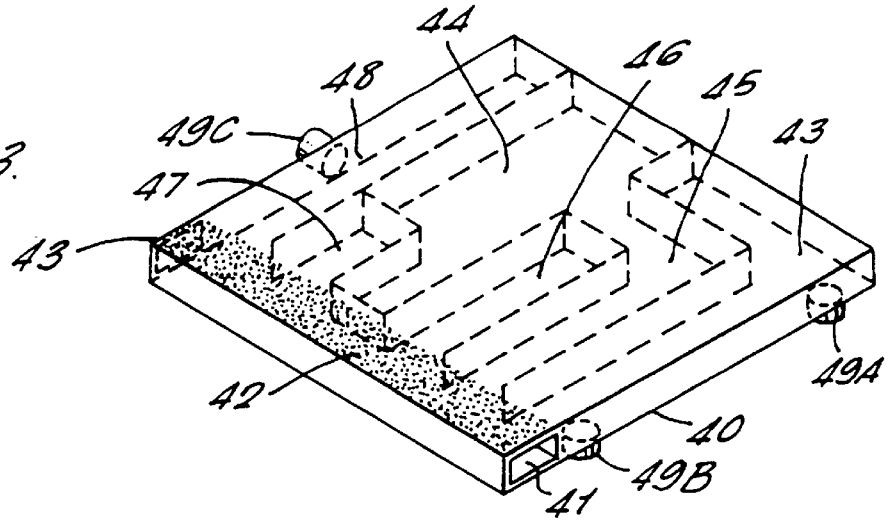
FIG. 3 is a schematic isometric view of a second embodiment of noise attenuator according to the present invention.

Thus it will be seen that the noise attenuator of FIG. 3 comprises four quarter wave resonators and one Helmholtz resonator. Also shown in the Figure are three rubber isolators 49A, 49B and 49C which allow connection of the housing 40 to a vehicle body. The isolators 49A, 49B and 49C attenuate transmission of vibration from the housing 40 to the vehicle body and thus lower the noise experienced by the driver.

Figure 4:
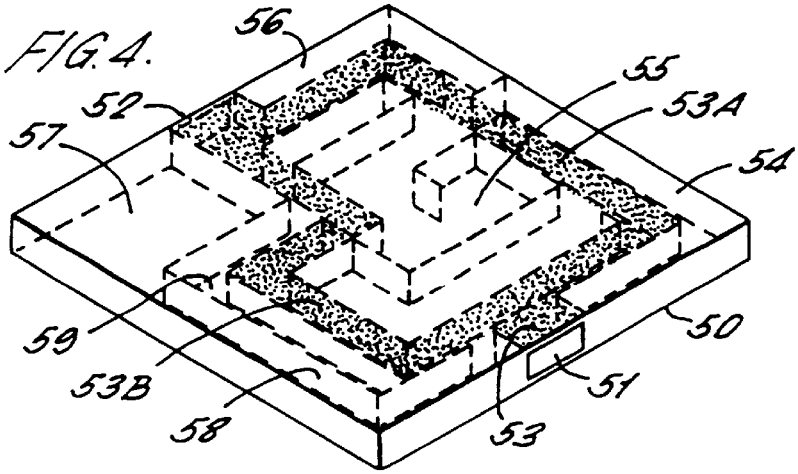
FIG. 4 is a schematic isometric view of a third embodiment of noise attenuator according to the present invention.

A third embodiment of the present invention is shown in FIG. 4 where the noise attenuator has a housing 50 which has an air inlet 51 which in use will be connected to an air filter of an internal combustion engine. The housing 50 also have an air outlet 52 which in use will be connected to an air inlet manifold of an internal combustion engine. The air inlet 51 is connected to the air outlet 52 by a gas flow passage 53 which comprises two separate flow paths 53A and 53B through the housing 50. Air flowing through the flow path 53 will flow initially through the air inlet 51 and then will divide into a first air flow through the path 53A and a second air flow through the path 53B. The air flows through the paths 53A and 53B will combine again before passing through the air outlet 52. In the embodiment shown the cross-sectional area of the air flow path 53A will be different to the cross-sectional area of the air flow path 53B. Opening onto the air flow path 53A are a quarter wave tube resonator 54, a Helmholtz resonator 55 and a quarter wave tube resonator 56. Opening onto the air flow path 53B are a Helmholtz resonator 57, which comprises an L-shaped inlet passage 58, and an L-shaped quarter wave tube resonator 59.

By diverting the air through separate flow paths 53A and 53B, the illustrated resonator can provide greater opportunity for tuning of the resonator to effectively cancel noise. By choosing the cross-sectional area of the air flow path 53A to be different to that of the air flow path 53B, different aspect ratios (i.e. the ratios between the cross-sectional areas of the gas flow paths and the cross-sectional areas of the resonators) can be made available.

Figure 5:
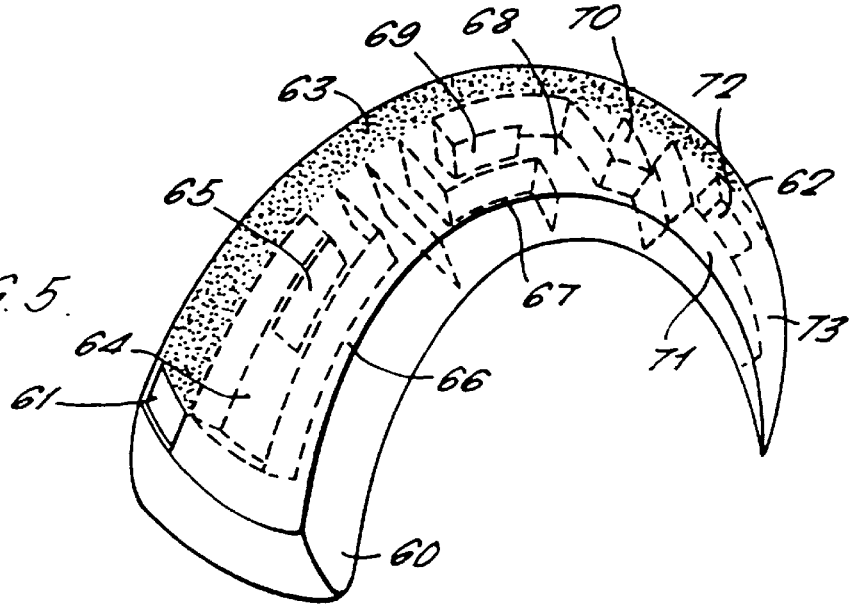
FIG. 5 is a schematic view of a fourth embodiment of noise attenuator according to the present invention.

FIG. 5 shows a fourth embodiment of the invention in which the noise attenuator comprises a housing 60 which is shaped to provide a wheel arch liner for an automobile. Thus, it will be appreciated that the housing 60 serves a dual function since it functions both as a housing for the noise attenuator and also functions as a structural component of a vehicle, namely a wheel arch liner.

The housing 60 has an air inlet 61 and an air outlet 62, with an air flow path 63 connecting the air inlet 61 and the air outlet 62. Air flowing through the air flow path 63 (which is a curved path, due to the curved nature of the wheel arch liner), passes sequentially past:

- a Helmholtz resonator 64 having an L-shaped inlet passage 65;
- a U-shaped quarter wave tube resonator 66;
- an L-shaped quarter wave tube resonator 67;
- a Helmholtz resonator 68 having an L-shaped inlet passage 69;
- a quarter wave tube resonator 70;
- an L-shaped quarter wave tube resonator 71; and
- a Helmholtz resonator 73 having an L-shaped inlet passage 72.

The use of the housing 60 to provide a wheel arch liner will have an overall cost and weight saving advantage for the automobile which will not require separate components of a noise attenuator and a wheel arch liner. Furthermore, the use of the housing 60 as a wheel liner is a good use of dead space in the vehicle so that the engine bay can be kept uncluttered.

It will be appreciated that the present invention in all of its embodiments has numerous advantages. Whereas a current distributed resonator system in an automobile comprises roughly 12 liters of resonator volume, this can be cut down to around 7 liters, with a decrease in drive-by noise from 77 dB to 74 dB. Furthermore, the integrated unit provided by the present invention is of reduced weight in comparison with the distributed resonator system and is also of reduced cost. Furthermore, the pressure drop across the integrated unit is less than the combination of the pressure drops across distributed units and this can lead to a power output improvement of the engine. The integrated unit can be used as a structural component of the vehicle, for instance a wheel arch liner or a bonnet liner. The integrated unit can be made stiffer than the separate components that are currently used and also it is easy to connect the integrated unit via isolators to a vehicle body; both of these factors decrease the vibration transmitted to the vehicle body by the noise attenuator.

It has been found that the interaction of Helmholtz and quarter wave resonators within one integrated unit has a beneficial effect in achieving greater degrees of noise reduction with reduced volume. Locating the quarter wave and Helmholtz resonators together in one integrated unit leads to a synergistic effect in noise cancellation. This is because before it was assumed that it would be best to locate the separate noise attenuators at different parts in the air flow path of an air induction system of a vehicle, to take account of the wave form of the pressure profile of the air flowing through the air inlet path.

The Helmholtz resonator in the integrated unit will provide a better defined bandwidth of noise cancellation than the bandwidth provided by the quarter wave tube resonators. The interaction of the Helmholtz and quarter wave tube resonators in the one integrated unit leads to optimisation and this means that the total resonator volume of the integrated unit can be decreased relative to the volume obtained by summing the resonators were they to be connected as separate components.

The present invention can lead to a cost saving, because the integrated units provided by the present invention can be manufactured by moulding process in two parts. An injection moulding process using a nylon-based material would be particularly beneficial in providing a resonator with high tolerances, but a good degree of stiffness.

We claim:

1. A noise attenuator for an induction system or an exhaust system comprising a housing having:

a gas inlet, a gas outlet, a first gas flow passage inside the housing connecting the gas inlet to the gas outlet, and a quarter wave resonator tube inside the housing which opens on to the first gas flow passage, characterised in that there is additionally provided inside the housing a Helmholtz resonator which opens on to the first gas flow passage whereby the Helmholtz resonator and the quarter wave resonator tube are together integrated in a single unit and the single unit is connectable to and deconnectable from the induction system or the exhaust system.

2. A noise attenuator as claimed in claim 1 which is manufactured as a self-supporting integer.

3. A noise attenuator as claimed in claim 1 wherein the housing has a plurality of divider walls which at least partly define the first gas flow passage, the quarter wave resonator tube and the Helmholtz resonator.

4. A noise attenuator as claimed in claim 3 wherein at least one divider wall has one side which provides an inwardly facing surface of the quarter wave resonator tube and a second side which provides an inwardly facing surface of the Helmholtz resonator.

5. A noise attenuator as claimed in claim 3 wherein the housing comprises two moulded parts which when joined together provide the divider walls and define the first gas flow passage, the quarter wave resonator tube and the Helmholtz resonator.

6. A noise attenuator as claimed in claim 1 wherein the quarter wave tube has a non-circular axial cross-section.

7. A noise attenuator as claimed in claim 6 wherein each quarter wave resonator tube has a generally rectangular axial cross-section.

8. A noise attenuator as claimed in claim 1 wherein the Helmholtz resonator has an inlet passage of non-circular axial cross-section.

9. A noise attenuator as claimed in claim 8 wherein the inlet passage of the Helmholtz resonator has a generally rectangular axial cross-section.

10. A noise attenuator as claimed in claim 1 wherein a plurality of gas flow passageways are provided in the housing connecting the gas inlet to the gas outlet, at least one quarter wave resonator tube or Helmholtz resonator opening on to each gas flow passage.

11. A noise attenuator as claimed in claim 1 comprising mounting means for securing the housing to a structure, the mounting means comprising isolator means which attenuate transmission of vibration from the housing to the structure.

12. A noise attenuator as claimed in claim 1 additionally comprising a second Helmholtz resonator inside the housing.

13. A noise attenuator as claimed in claim 1 additionally comprising a plurality of quarter wave resonator tubes inside the housing.

14. A noise attenuator as claimed in claim 13 wherein at least a first quarter wave resonator tube is provided on one side of the first gas flow passage and at least a second quarter wave resonator tube is provided on the opposite side of the first gas flow passage.

15. A noise attenuator as claimed in claim 13 wherein at least one quarter wave resonator tube is L-shaped.

16. A noise attenuator as claimed in claim 13 wherein at least one quarter wave resonator tube has a straight portion and a curved portion.

17. A noise attenuator as claimed in claim 1 wherein the or a Helmholtz resonator has a cavity which is L-shaped in cross-section.

18. A noise attenuator as claimed in claim 1 wherein the or a Helmholtz resonator has a cavity which is at least partly defined by a curved surface.

19. A noise attenuator as claimed in claim 1 wherein the housing is constructed to have a first dimension which is smaller than half of each of the other two dimensions of the housing.

20. A noise attenuator as claimed in claim 1 wherein the first gas flow passage is defined within the housing in such a manner that gas flowing through the first gas flow passage passes sequentially past the Helmholtz resonator and the quarter wave resonator tube opening on to the first gas flow passage.

21. A noise attenuator as claimed in claim 1 for use in an automobile wherein the housing contains a resonator volume in the range of 6 to 10 liters.

22. A method of manufacture of the noise attenuator claimed in preceding claim 1 which comprises mounding a first part of the housing with open channels each having a base and side walls, moulding a second part of the housing with matching open channels each having a base and side walls and joining the first and second parts together so that the open channels cooperate to define the gas flow passage, Helmholtz resonator and the quarter wave tube resonator in the housing.

23. A method of manufacture as claimed in claim 22 wherein the noise attenuator is manufactured as a self-supporting unit for subsequent connection in an induction or exhaust system.

24. A method of manufacture as described in claim 22 wherein at least one part is formed by injection moulding.

25. A method of manufacture as claimed in claim 24 wherein at least one part is made of polypropylene.

26. A method of manufacture as claimed in claim 24 wherein at least one part is made of a nylon based plastic.

27. A method of use of the noise attenuator claimed in claim 1 in a vehicle which comprises using the housing of the noise attenuator to provide a structural part of the vehicle.

28. A method of use as claimed in claim 27 comprising using the housing to define a wheel arch liner.

29. A method of use as claimed in claim 27 comprising using the housing to define part of a bumper.

30. An air induction system of an internal combustion engine comprising an air filter, an intake manifold and the noise attenuator claimed in claim 1 wherein the air filter is connected to the gas inlet of the noise attenuator and the intake manifold is connected to the gas outlet of the noise attenuator.

31. An air induction system of an internal combustion engine comprising an air filter, an air inlet and the noise attenuator claimed in claim 1 wherein the air inlet is connected to the gas inlet of the housing of the noise attenuator and the gas outlet of the housing of the noise attenuator is connected to the air filter.

32. An air induction system as claimed in claim 30 wherein an inwardly facing surface of a or the quarter wave resonator tube in the housing is at least partially coated with a secondary material which enhances noise attenuation.

33. An air induction system as claimed in claim 30 wherein an inwardly facing surface of a or the Helmholtz resonator is at least partially coated with a secondary material which enhances noise attenuation.

34. An exhaust system for an internal combustion engine comprising an exhaust manifold, an exhaust outlet and a noise attenuator as claimed in claim 1, wherein the exhaust manifold is connected to the gas inlet of the housing of the noise attenuator and the exhaust outlet is connected to the gas outlet of the housing of the noise attenuator.

* * * * *